US005431298A

United States Patent [19]

Ahn et al.

[11] Patent Number: 5,431,298

[45] Date of Patent: Jul. 11, 1995

[54] CONVERTIBLE MULTIPURPOSE PLASTIC CONTAINER

[76] Inventors: Young-Nam Ahn; Hyoung B. Ahn; Hyoung K. Ahn, all of 494-1 Kyo-Ri, Yangsan-Eop, Kyungnam-Do, Rep. of Korea

[21] Appl. No.: 166,004

[22] Filed: Dec. 14, 1993

[30] Foreign Application Priority Data

Mar. 10, 1993 [KR] Rep. of Korea ..... 93-3594

[51] Int. Cl.[6] ..... B65D 25/04; B65D 25/28

[52] U.S. Cl. ..... 220/756; 206/45.2

[58] Field of Search ..... 206/546, 547, 545, 48.2; 220/756

[56] References Cited

U.S. PATENT DOCUMENTS

| | | | |
|---|---|---|---|
| 1,183,791 | 5/1916 | Arakawa | 206/546 |
| 2,603,500 | 7/1952 | Messier | 206/546 |
| 2,645,332 | 7/1953 | Martin et al. | 206/546 |
| 2,731,996 | 1/1956 | Hayes | 206/546 |
| 2,944,694 | 7/1960 | Kinsey | 206/546 |
| 2,983,402 | 5/1961 | Gottsegen | 220/756 |
| 3,979,007 | 9/1976 | Thornbloom Jr. | 220/756 |
| 4,133,335 | 1/1979 | Malafouris | 220/756 |
| 4,592,482 | 6/1986 | Seager | 220/756 |

*Primary Examiner*—Joseph Man-Fu Moy

[57] ABSTRACT

A convertible multipurpose container includes a container body, a pair of lids, a pair of supporting members for supporting handles, and an extra plate whereby upon outwardly opening the lids, the extra plate is combined with the lids to become a composite plate for receiving articles thereon.

4 Claims, 5 Drawing Sheets

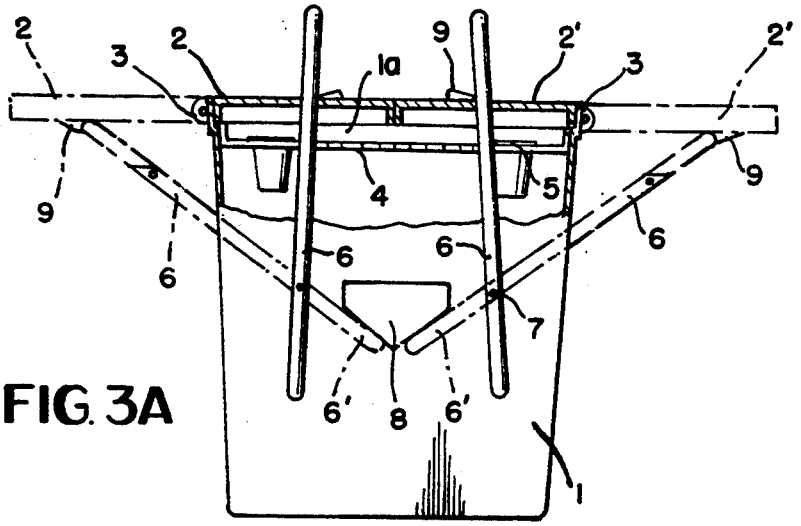
FIG. 3A
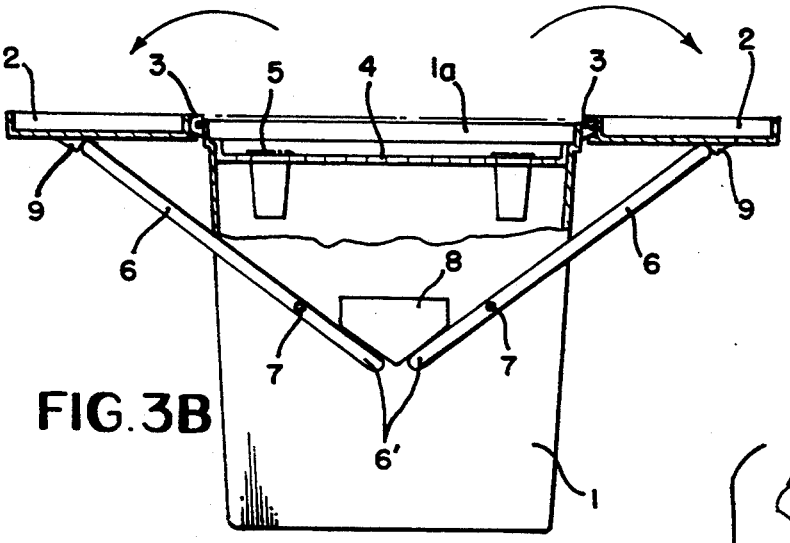
FIG. 3B
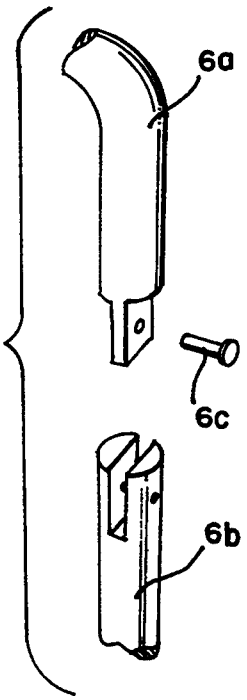
FIG. 4
FIG. 5A
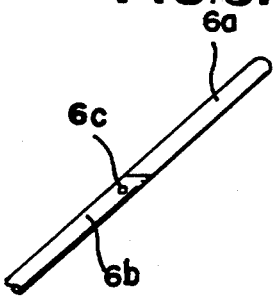
FIG. 5B
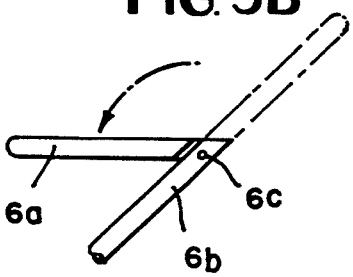

FIG. 9
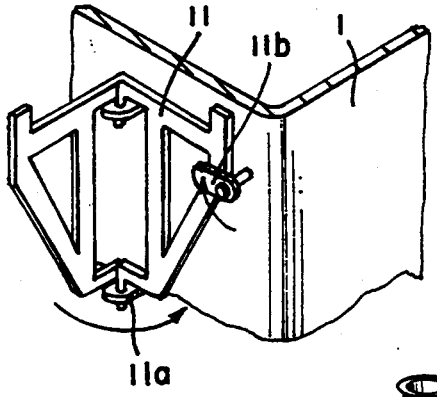
FIG. 10
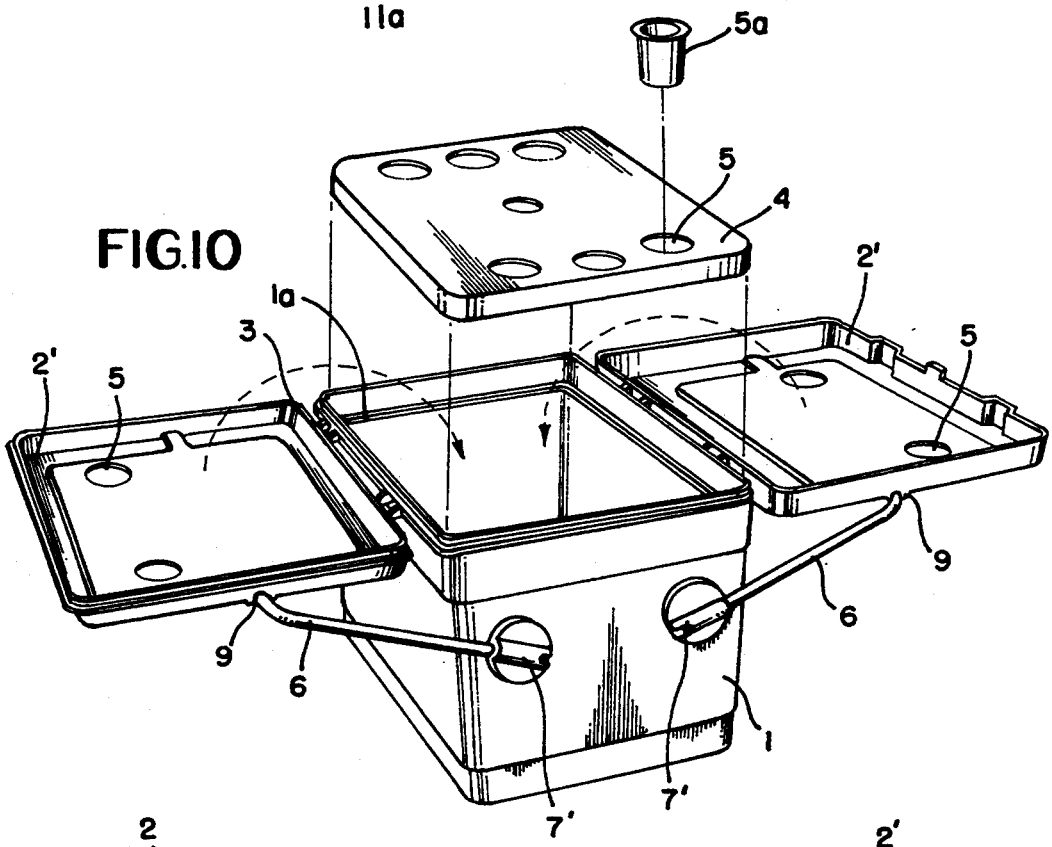
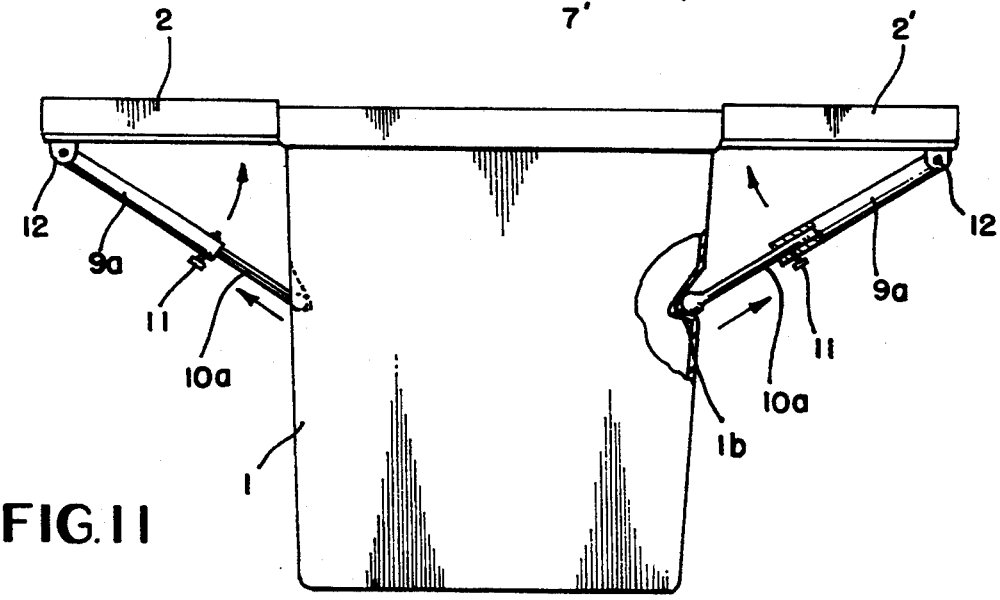
FIG. 11

CONVERTIBLE MULTIPURPOSE PLASTIC CONTAINER

BACKGROUND OF THE INVENTION

1. Field of the Invention

The present invention relates to a convertible multipurpose container such as a cold chest, a food container, and the like. More particularly, the present invention relates to a plastic container having a pair of lids convertible to a table plate which is combined with an extra plate supported on the plastic container while the lids are opened outwardly.

2. Description of Related Art

Generally, plastic containers to store food have a lid which is used to cover the container. Accordingly, when the user takes food from the container in the outdoors such as parks, camping areas, and the like, the user needs a plate for putting food thereon. Sometimes, the user handcarries a separate table for putting food thereon. It is difficult to take food without use of a food table. Also, it is expensive and inconvenient to provide a separate food table.

SUMMARY OF THE INVENTION

Accordingly, it is an object of the present invention to provide a convertible multipurpose container, which eliminates the above problems encountered with conventional plastic containers.

Another object of the present invention is to provide a container which includes a pair of lids, a pair of handles pivotally connected to two pairs of pins at the end portions thereof, a pair of raised stoppers attached to both side walls of the container and in the vicinity of the pins, and an extra plate supported in the plastic container, whereby upon outwardly opening the pair of lids, the pair of handles support the lids and both side lids and the center extra plate form a table plate for putting food thereon.

A further object of the present invention is to provide a convertible multipurpose container which further includes a pair of separate supports for supporting a pair of lids when the pair of lids are opened outwardly.

Still another object of the present invention is to provide a convertible multipurpose container which further includes a pair of collapsible supports attached to front and rear walls thereof for supporting a pair of lids when the pair of lids are opened outwardly.

Yet another object of the present invention is to provide a convertible multipurpose container which further includes a pair of lockable supporting rods slidably attached to the tops of a pair of lids and a pair of engaging grooves disposed at walls thereof for receiving the pair of lockable supporting rods when the pair of lids are opened outwardly.

A further object of the present invention is to provide a convertible multipurpose container which further includes two pairs of tubular containers and four supporting rods slidably inserted into the tubular containers for supporting a pair of lids when the pair of lids are opened outwardly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a convertible multipurpose container which includes a container body, a pair of lids, means for supporting the lids, and an extra plate supported on the body whereby upon outwardly opening the pair of lids, the extra plate is combined with the pair of lids to form a table plate for putting food thereon.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 3A and 3B are side elevational views of the convertible multipurpose plastic container according to the present invention, showing operation of a pair of handles and how they support a pair of lids of the convertible multipurpose container of the present invention;

FIGS. 4, 5A, and 5B are perspective views of the handle of the container according to the present invention, showing a bendable handle of another preferred embodiment of the present invention;

FIGS. 7, 8, and 9 illustrate the convertible multipurpose container employing a third preferred embodiment of means for supporting the pair of lids according to the present invention;

FIG. 10 is an exploded perspective view of another preferred embodiment of the convertible multipurpose plastic container of the present invention;

FIG. 11 illustrates the convertible multipurpose container employing a fourth preferred embodiment of means for supporting the pair of lids according to the present invention.

DESCRIPTION OF THE PREFERRED EMBODIMENTS

Figure 1:
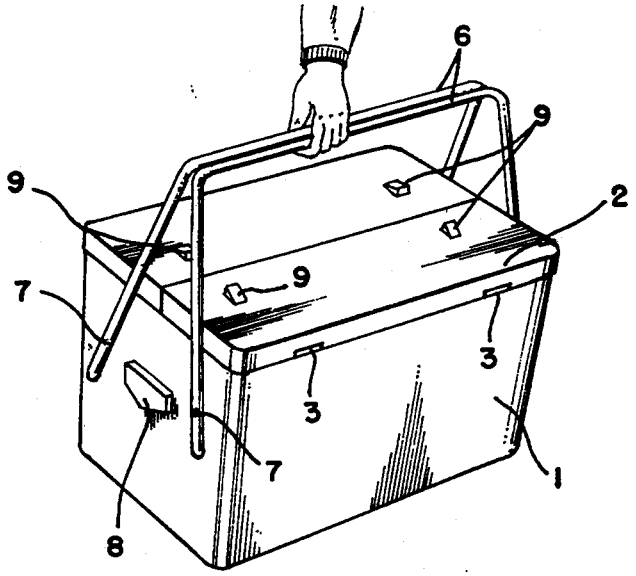
FIG. 1 is a perspective view of the convertible multipurpose container according to the present invention, showing a handy carriage thereof.
Figure 2:
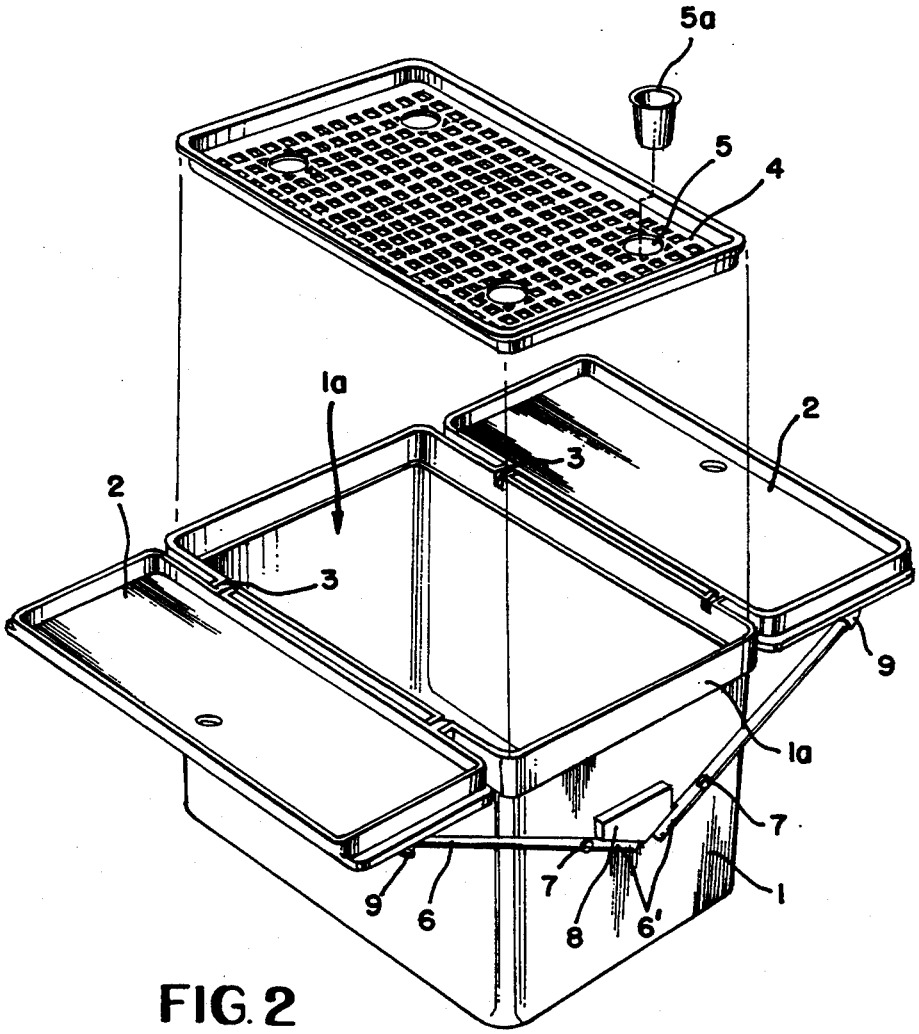
FIG. 2 is an exploded perspective view of the convertible multipurpose container according to the present invention.

Referring now in detail to the drawings for the purpose of illustrating preferred embodiments of the present invention, the convertible multipurpose container as shown in FIGS. 1, 2, 3A, and 3B comprises a container body 1, a pair of lids 2 pivotally connected to the body through hinges 3, a pair of handles 6 pivotally connected to the body 1 by first pivot pins 7, and an extra plate 4 disposed in a container interior la, to be combined with the pair of lids 2 for forming a table plate.

As shown in FIGS. 3A and 3B, each handle end portion 6' of the pair of handles 6 is to be stopped by a pair of first stoppers 8 attached to both side walls of the container body 1. The first stopper 8 forms a raised portion and has a pentagonal configuration so that a pair of sloped lower edges becomes a stopping portion for the handle end portions 6' of the handles 6, respectively. Therefore, the pair of handles 6 function as a supporter to the pair of lids 2 when the pair of lids 2 are outwardly opened (FIG. 3B).

At this time, two pairs of second stoppers 9 disposed on the pair of lids 2 retain the handles 6 for forming a planar dining plate. Also, the extra plate 4 having a plurality of cup holes 5 for putting cups therein seats on an opening 1*a* of the plastic container, so that the pair of lids 2 supported by the pair of handles 6 form a table plate with the extra plate 4 (FIG. 3B). Accordingly, the plastic container can be converted to a dining table for putting food thereon.

As shown in FIGS. 4, 5A, and 5B, the handle 6 can be jointed on an upper part 6*a* and a lower part 6*b* by a second pivot pin 6*c* for conveniently carrying the plastic container.

Figure 6:
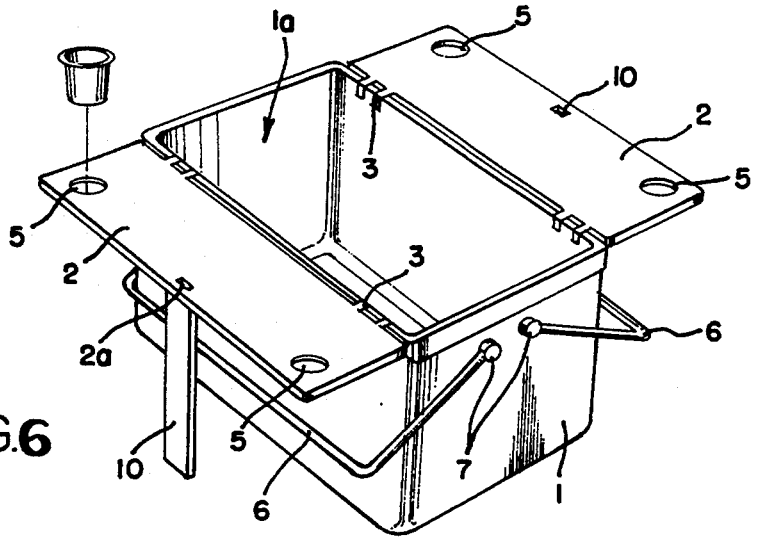
FIG. 6 is an exploded perspective view of the convertible multipurpose container employing another preferred embodiment of means for supporting the pair of lids according to the present invention.

Referring in detail to FIG. 6, there is illustrated an additional embodiment of the convertible multipurpose plastic container in accordance with the present invention. A pair of supporting members 10 support a pair of lids 2 of the plastic container. Each supporting member 10 has a small size top portion for engaging with a groove 2*a* formed in the extra plate lid 2.

Figure 7:
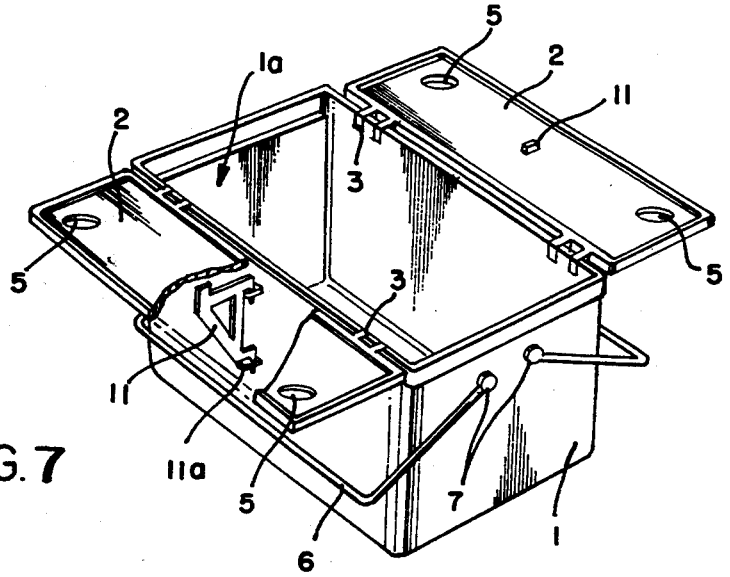
Figure 8:
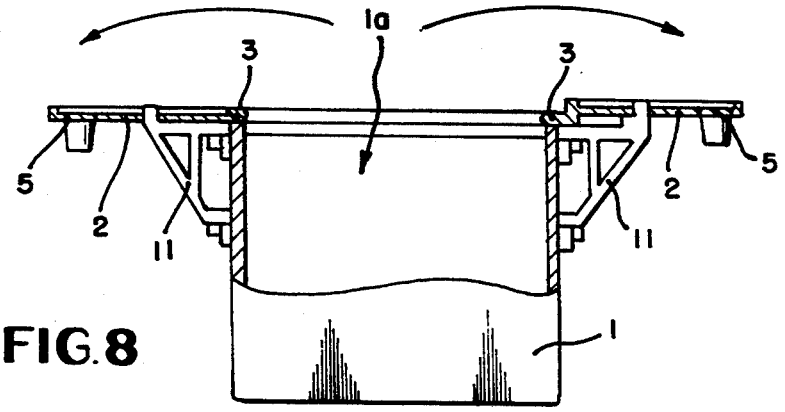

Referring in detail to FIGS. 7 and 8, there is illustrated a third embodiment of the convertible multipurpose plastic container in accordance with the present invention. A pair of collapsible supports 11 are pivotally attached to front and rear walls of the container body 1 by a pair of holes 11a disposed in raised parts extended from the front and rear walls. The collapsible supports 11 rotatable at a right angle about the walls and tips of the collapsible support 11 are tightly engaged with the engaging holes 2*a*, so that the pair of collapsible supports 11 are effectively supported against the pair of lids 2 (FIG. 8). When the pair of supports 11 are in the collapsed state, the supports 11 are attached to the walls and locked by a pair of locking members 11*b* (FIG. 9).

As shown in FIG. 10, there is illustrated a fourth embodiment of the convertible multipurpose plastic container in accordance with the present invention. The convertible plastic container includes the container body 1, double doors 2' pivotally connected to the body 1 through the hinges 3, the pair of handles 6 pivotally connected to both side walls of the body 1, and an extra plate 4 having a plurality of cup holes 5 for a cup 5*a*.

The handles 6 are movably inserted into two pairs of handle engagements 7; pivotally attached to both side walls of the container body 1 at the ends thereof. The engagements 7' have their locking systems disposed therein (not shown) so that both handles 6 can effectively support the pair of double doors 2' (FIG. 10). When the doors 2' close, one door 2' is stacked on the other door 2'.

Referring in detail to FIG. 11, there is illustrated a fifth embodiment of the convertible multipurpose plastic container in accordance with the present invention. A pair of collapsible and lockable supporting rods 10*a* are pivotally attached to the tops of the pair of lids 2 through second pivots 12. Each lockable supporting rod 10*a* is slidably disposed within a tube 9*a* and can be tightly locked by a locking bolt 11. Also, each lockable supporting rod 10*a* is tightly engaged with an engaging groove 1*b* formed on the side walls thereof, so that the pair of lockable supporting rods 10*a* are effectively supported against the pair of lids 2 (FIG. 11). When the pair of tubes 9*a* containing each supporting rod 10*a* are in a collapsed state, the tubes 9*a* are attached to the lids 2 and locked by a pair of locking members (not shown).

Figure 12:
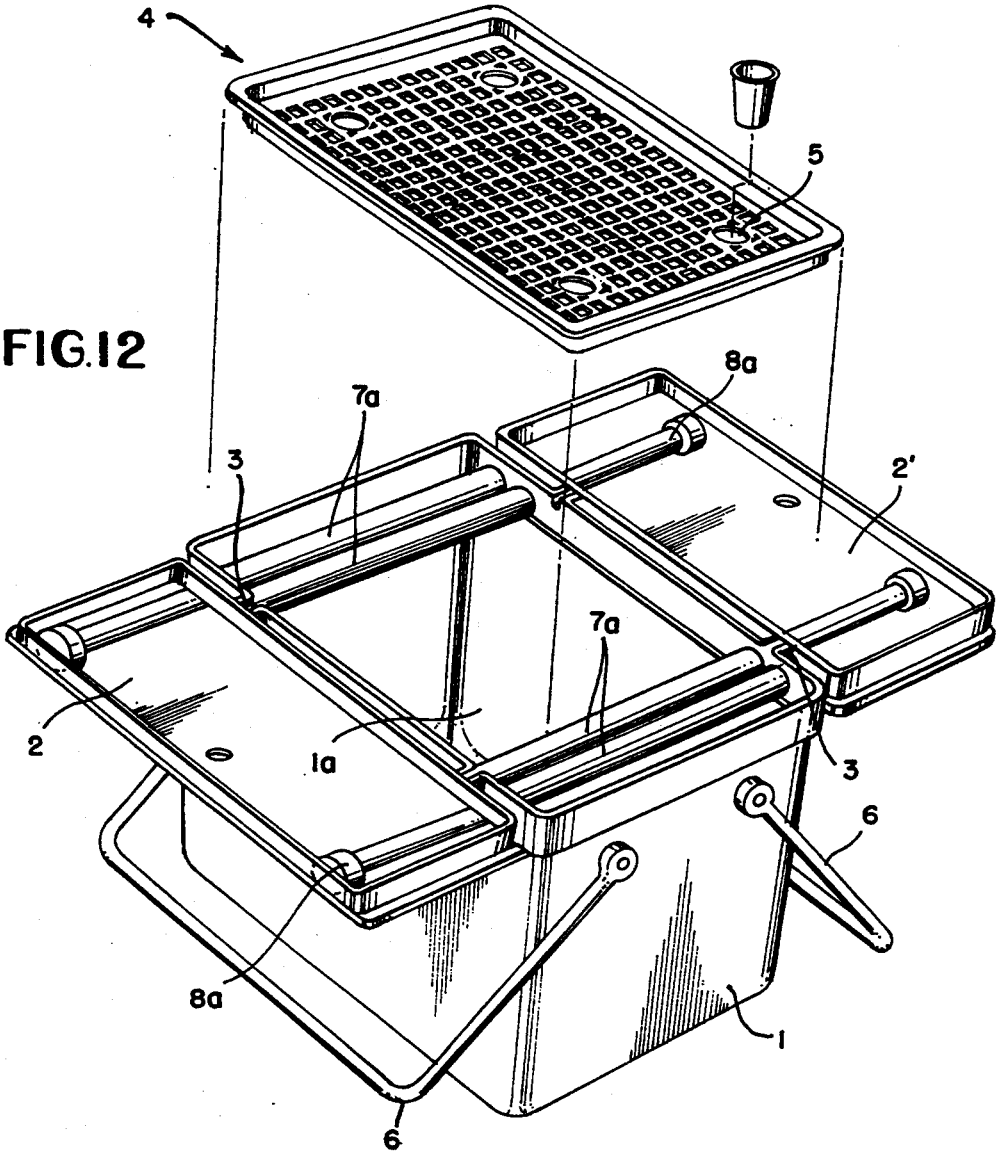
FIGS. 12 and 13 illustrate the convertible multipurpose container employing a fifth preferred embodiment of means for supporting the pair of lids according to the present invention.
Figure 13:
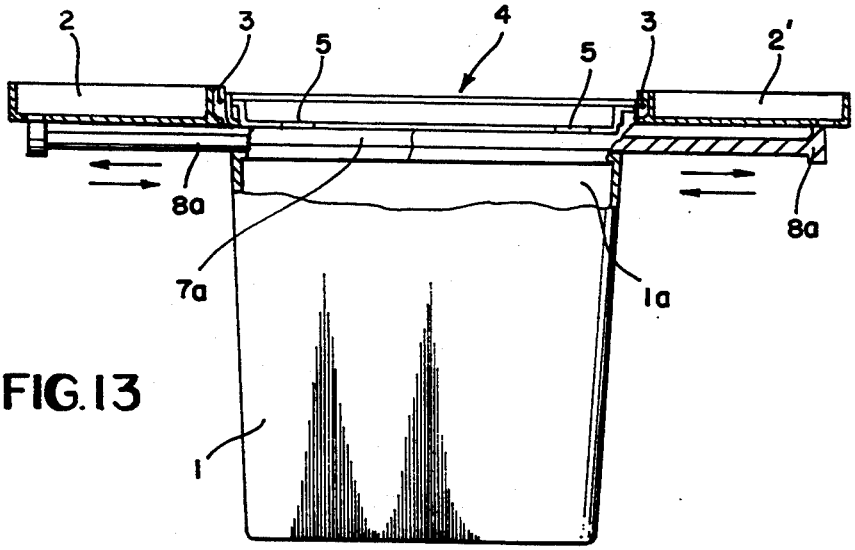

As shown in FIGS. 12 and 13, there is illustrated a sixth embodiment of the convertible multipurpose plastic container in accordance with the present invention. The convertible plastic container includes two pairs of tubular containers 7*a* attached/mounted to the upper portions of the container body 1 and four supporting rods 8*a* slidably disposed within the tubular containers 7*a*, respectively, and slidably inserted into the pair of lids 2, so that the supporting rods 8*a* are effectively supported against the pair of lids (FIG. 13). When the pair of supporting rods 8*a* are in the collapsed state, the supporting rods 8*a* are inserted into the tubes 7*a*.

Accordingly, the convertible multipurpose plastic container of the present invention can be easily converted to a dining table for putting foods thereon.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A convertible multipurpose cold chest for storing food, comprising:
   - a container body defining front, rear, and a pair of side walls,
   - a pair of lids pivotally connected to said container body by hinges,
   - a pair of handles which are pivotally attached to said both side walls of the container body by first pivot pins;
   - means for supporting said pair of handles, whereby upon opening the pair of lids, the lids are supported by the handles, wherein said means for supporting are a pair of pentagonal configured raised portions fixed to said pair of side walls of the container body each pentagonal raised portion having a pair of sloped lower edges for functioning as a stopper to the two pair of end portions of the handles and
   - an extra plate removably disposed in said container body, whereby upon opening the pair of lids, the opened lids are combined with the extra plate to become a dining plate, so that the convertible multipurpose container is convertible to a composite plate.

2. The convertible multipurpose cold chest of claim 1, wherein said pair of lids are provided with a pair of stoppers, respectively, for receiving the pair of handles thereagainst.

3. The convertible multipurpose container of claim 1, wherein said pair of handles include lower and upper parts wherein the lower and upper parts are pivotally connected to each other by a pin.

4. The convertible multipurpose container of claim 1, wherein said pair of lids are opposed to each other for bidirectionally enlarging the composite plate.

* * * * *